US006530793B2

(12) United States Patent
Eichhorn et al.

(10) Patent No.: US 6,530,793 B2
(45) Date of Patent: Mar. 11, 2003

(54) MULTIPOLE CONNECTOR ASSEMBLY FOR LOW-VOLTAGE APPLIANCES

(75) Inventors: Reinhold Eichhorn, Idstein (DE); Michael Harms, Oberursel (DE); Sebastian Hottenrott, Idstein (DE); Peter Junk, Schmitten (DE); Michael Odemer, Niddatal (DE); Jens Störkel, Frankfurt (DE); Roland Ullmann, Offenbach (DE); Jürgen Wolf, Kriftel (DE)

(73) Assignee: Braun GmbH (DE)

( * ) Notice: Subject to any disclaimer, the term of this patent is extended or adjusted under 35 U.S.C. 154(b) by 0 days.

(21) Appl. No.: 10/081,305

(22) Filed: Feb. 20, 2002

(65) Prior Publication Data

US 2002/0081880 A1 Jun. 27, 2002

Related U.S. Application Data

(63) Continuation of application No. PCT/EP00/07355, filed on Jul. 29, 2000.

(30) Foreign Application Priority Data

Aug. 24, 1999 (DE) ..... 199 40 101

(51) Int. Cl.[7] ..... H01R 27/00
(52) U.S. Cl. ..... 439/218; 439/660
(58) Field of Search ..... 439/218, 217, 439/219–224, 151, 177, 660, 908, 954, 518, 676, 907

(56) References Cited

U.S. PATENT DOCUMENTS

| | | | | |
|---|---|---|---|---|
| 3,101,231 A | * | 8/1963 | Klostermann | 439/660 |
| 3,365,694 A | * | 1/1968 | Parker | 439/660 |
| 5,116,247 A | * | 5/1992 | Enomoto et al. | 439/660 |
| 5,268,629 A | | 12/1993 | Franke | 320/2 |
| 5,530,334 A | | 6/1996 | Ramspeck et al. | 320/2 |
| 5,554,036 A | * | 9/1996 | Shirai et al. | 439/74 |
| 5,576,530 A | * | 11/1996 | Hagerty | 235/472 |
| 5,906,518 A | | 5/1999 | Sun | 439/660 |
| 5,975,916 A | * | 11/1999 | Okura | 439/74 |
| 6,010,370 A | * | 1/2000 | Aihara et al. | 439/660 |

FOREIGN PATENT DOCUMENTS

| | | |
|---|---|---|
| DE | 8029343 | 2/1981 |
| DE | 3304045 | 8/1984 |
| DE | 4301602 | 4/1994 |
| DE | 4334426 | 4/1994 |
| DE | 19540304 | 4/1997 |

* cited by examiner

*Primary Examiner*—P. Austin Bradley
*Assistant Examiner*—Ross Gushi
(74) *Attorney, Agent, or Firm*—Fish & Richardson PC

(57) ABSTRACT

The invention is directed to a multipole connector assembly for connection of a low voltage to an electric appliance (E) of personal use, with a plug (6) insertable into a socket (5) and with contactable contact elements (1 to 4, 10, 20, 30, 40) for a polarized voltage transfer, wherein the socket (5) and the plug (6) are constructed as polygonal profile bodies (M1 to M12) reversible from one plug-in position to at least one further plug-in position about a symmetry axis (S), wherein provision is made on each polygonal profile body (M1 to M12) for contact elements (1 to 4, 10, 20, 30, 40) of at least one first pole (+) and one second pole (–), wherein the contact elements of the first pole (+) and of the second pole (–) are provided on the polygonal profile body faces of the polygonal profile bodies (M1 to M12) in alternating sequence in a direction of rotation (U), and wherein on at least one of the polygonal profile bodies (M1 to M12) the contact elements have a relatively large contact face for making large-surface contact with the contact face of an engaging contact element (1 to 4, 10, 20, 30, 40).

35 Claims, 4 Drawing Sheets

MULTIPOLE CONNECTOR ASSEMBLY FOR LOW-VOLTAGE APPLIANCES

This is a continuation of PCT application serial no. PCT/EP00/07355, filed Jul. 29, 2000, which claims priority from German application serial number 19940101.2, filed Aug. 24, 1999, (pending).

This invention related to a multiple connection assembly of the type initially referred to is known from the German standard "DIN 45323 dated October 1982". The plug essentially comprises a contact sleeve fastened in an insulating body, which sleeve is engaged by a bent V-shaped contact spring of a socket when the socket and plug are coupled. The circular construction of the contact sleeve and the V-shape of the contact spring produce a point-based contact in the area of engagement of these two components, as a result of which there is no guarantee that relatively large currents for the charging of storage cells and/or operation of a connected appliance are transferred without loss.

It is an object of the present invention to improve a multipole connector assembly of the type initially referred to.

This object is accomplished in accordance with the invention by the features identified in claim 1.

A further solution for accomplishing the object of the invention is characterized by the features set out in claim 2.

An essential advantage of the invention is that, by constructing the socket and the plug as reversible polygonal profile bodies, wall faces are formed that can be provided with one or more contact elements having a relatively large contact area for making large-surface contact with the contact face of any contact element that engages it. Through the large-surface contact between contact elements of a first pole and contact elements of similar polarity as well as between contact elements of a second pole and contact elements of similar polarity there is a guarantee that relatively large currents can be transmitted largely without loss although the dimensions of the multipole connector assembly are relatively small. A relatively large expanse of a contact element's face guarantees large-surface contact between it and a contact face, whether of a plane or a convex or an angled configuration, of a contact element engaging it. A large-surface contact between a relatively large contact face and a contact element formed, for example, from a single- or multi-feathered contact spring can be guaranteed, with the size of the engaging contact face being adapted to be influenced by the elasticity of the contact spring. Contact between the proper poles of the contact elements provided on a polygonal profile body is guaranteed by the reversibility of socket and plug about a common symmetry axis through suitable forming of the profile of the intermateable polygonal profile bodies of socket and plug. The polygonal profile bodies of socket and plug, which cooperate by positive engagement with each other, also guarantee that the socket and plug are easy and simple to couple and uncouple.

An essential advantage of the solution set out in claim 2 is that, without impairing the transfer of a low voltage from a voltage source, for example a transformer, to a charging circuitry of an electric appliance, it is possible for one of the polygonal profile bodies—for example the socket—to be provided with one less contact element of a first pole (+) or a second pole (−) without this resulting in any impairment of the voltage transfer.

Each of the two solutions mentioned above guarantees sufficient large-surface contact between the provided contact elements as well as a reliable assignment of the contact elements of similar polarity—i.e., the assignment of a first pole (+) to a neighboring first pole (+) and of a second pole (−) to a neighboring second pole (−)—both when inserting the plug in the socket and when reversing the plug from one plug-in position to at least one further plug-in position. The two solutions according to the invention permit a multiplicity of different embodiments, each of which can be used to advantage in practice. For example, it is possible on the one hand for the intermateable polygonal profile bodies of socket and plug to have different geometrical forms and, on the other hand, for the polygonal profile bodies of the plug and the socket to be provided with several contact elements according to requirements, provided the polygonal profile bodies with the edges can be plugged together by positive engagement with each other.

The subject of the invention is preferably suitable for use on electric appliances of personal use where the user is often required to effect the transfer of a low voltage from a power supply, e.g., a low-voltage transformer, to the electric appliance, in which case it is important for the user to be able to make the plug-and-socket connection ensuring the power supply in simple manner with the proper poles in relative contact without his having to pay attention to how the correctly poled contact comes about. Electric appliances of this type are in particular shaving apparatuses, oral care appliances, telephones—more particularly mobile telephones—, hand-held appliances equipped with rechargeable storage cells and the like.

A preferred embodiment of the invention is characterized in that at least one contact element is provided on each wall of the plug.

In a further aspect of this embodiment at least one contact element is provided on each wall of the socket.

A very simple embodiment of the invention affording economy of manufacture is characterized in that at least two contact elements of the first pole are provided in opposed relation to each other on the polygonal profile body of the plug. In a further aspect of this embodiment two contact elements of the second pole are provided in opposed relation to each other on the polygonal profile body of the plug. To accommodate this embodiment at least two contact elements of the first pole are provided in opposed relation to each other on the polygonal profile body of the socket, and at least two contact elements of the second pole are provided in opposed relation to each other on the polygonal profile body of the socket.

According to a further advantageous embodiment of the invention the contact elements of the first pole and of the second pole are provided on opposite and/or neighboring walls of the plug and the socket.

For a relatively simple and low-cost connector assembly it suffices for the contact elements to be provided on at least two walls of the polygonal profile body of the plug. To accommodate this embodiment the contact elements are provided on at least two walls of the polygonal profile body of the socket.

In connection with a connector assembly formed by the positive-engagement elements of the intermateable polygonal profile bodies of the plug and the socket, proper contact is guaranteed by providing on the plug and the socket two contact elements of the first pole and one of the second pole, and on the coupleable polygonal profile body two contact elements of the first pole and two contact elements of the second pole.

A preferred solution according to the invention is characterized in that at least one contact element with a first pole and a second pole is provided on a first wall, and the contact elements on the other walls of the plug and socket are arranged in the same order of polarity of the contact elements provided on the first wall.

A further advantageous embodiment of the invention is characterized in that the polygonal profile bodies of the plug and the socket are formed from reversible four-cornered profile bodies with at least two contact elements of dissimilar polarity, with the contact elements of the first pole (+) and of the second pole (−) being provided in centrosymmetric relation to each other on the walls of the plug and the socket.

According to yet another advantageous embodiment of the invention provision is made for the polygonal profile bodies of the plug and of the socket to be formed from reversible rectangular profiles.

According to a preferred embodiment of the invention provision is made for the polygonal profile bodies of the plug and of the socket to be formed from reversible square profile bodies.

According to a further embodiment of the invention provision is made for the polygonal profile bodies of the plug and of the socket to be formed from reversible triangular profile bodies.

According to yet another embodiment of the invention provision is made for the polygonal profile bodies of the plug and of the socket to be formed from reversible pentagonal or hexagonal profile bodies.

According to a preferred embodiment of the invention provision is made for the polygonal profile bodies of the plug and of the socket to have at least two outer walls extending parallel to each other, and further outer walls of congruent form linking the aforesaid outer walls to form a closed geometrical body.

According to a preferred embodiment of the invention provision is made for the socket to have at least two inner walls extending parallel to each other, and further walls of congruent form linking the aforesaid inner walls to form a closed geometrical body.

According to a preferred embodiment of the invention provision is made for the contact elements to be constructed as contact plates.

According to a preferred embodiment of the invention provision is made for at least one contact element to be of an essentially U-shaped configuration.

According to a preferred embodiment of the invention provision is made for at least one contact element to be of an essentially L-shaped configuration.

According to a preferred embodiment of the invention provision is made for at least two U-shaped contact elements of dissimilar polarity to be provided on a polygonal profile body of the plug and/or socket.

According to a preferred embodiment of the invention provision is made for at least one U-shaped contact element and at least two L-shaped contact elements to be provided on the polygonal profile body of the plug and/or socket.

According to a preferred embodiment of the invention provision is made for at least one wall of the polygonal profile body of the plug and/or socket to be spring-loaded.

According to a preferred embodiment of the invention provision is made for the spring-loadable wall to be equipped with a detent hook.

According to a preferred embodiment of the invention provision is made for at least two opposing walls of the polygonal profile body of the socket or the plug to be spring-loadable by means of a film hinge.

According to a preferred embodiment of the invention provision is made for the spring-loadable wall to be adapted to be acted upon by a spring element.

According to a preferred embodiment of the invention provision is made for the polygonal profile body of the plug to be part of a power cord.

According to a preferred embodiment of the invention provision is made for the polygonal profile body of the plug to be part of an electric appliance.

According to a preferred embodiment of the invention provision is made for the polygonal profile body of the socket to be part of a power cord.

According to a preferred embodiment of the invention provision is made for the polygonal profile body of the socket to be part of an electric appliance.

According to a preferred embodiment of the invention provision is made for the polygonal profile bodies of the plug and the socket to be part of two power cords adapted to be coupled together.

Further advantages and details of the present invention will become apparent from the subsequent description and the accompanying drawings illustrating some preferred embodiments. In the drawings, FIG. 1 is a perspective view of an electric appliance E, more particularly a shaving apparatus R;

Figure 6:
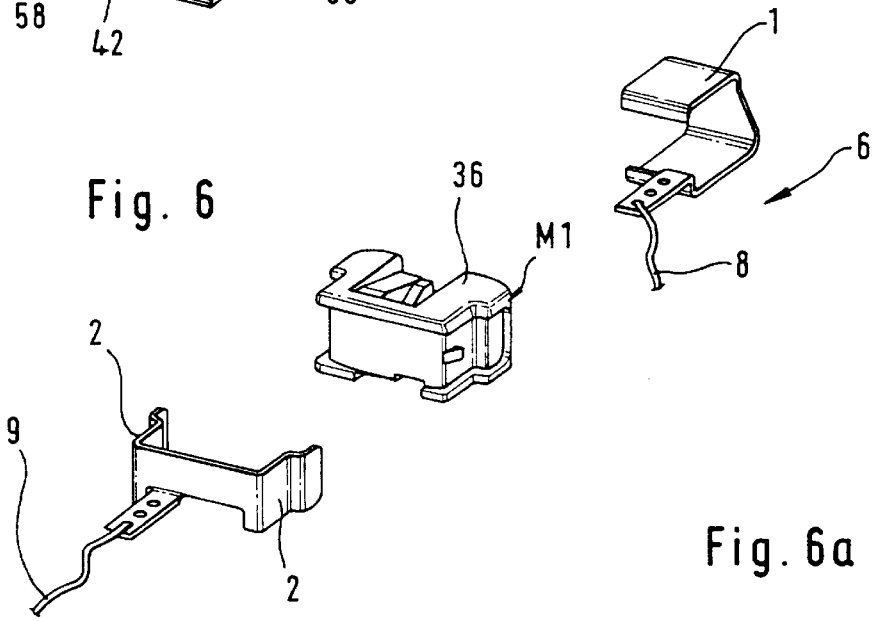
FIG. 6 is an exploded view of all the components of a plug.
Figure 6A:
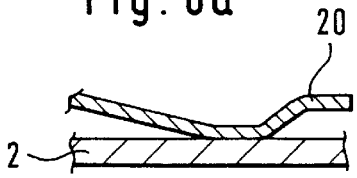

FIG. 6*a* is a view of two contact elements making large-surface engagement; and FIGS. 7 to 17 are views of different embodiments of intermateable plugs and sockets, showing in particular the shape design of polygonal profile bodies and variants of contacts between intermateable polygonal profile bodies of plug and socket.

Figure 1:
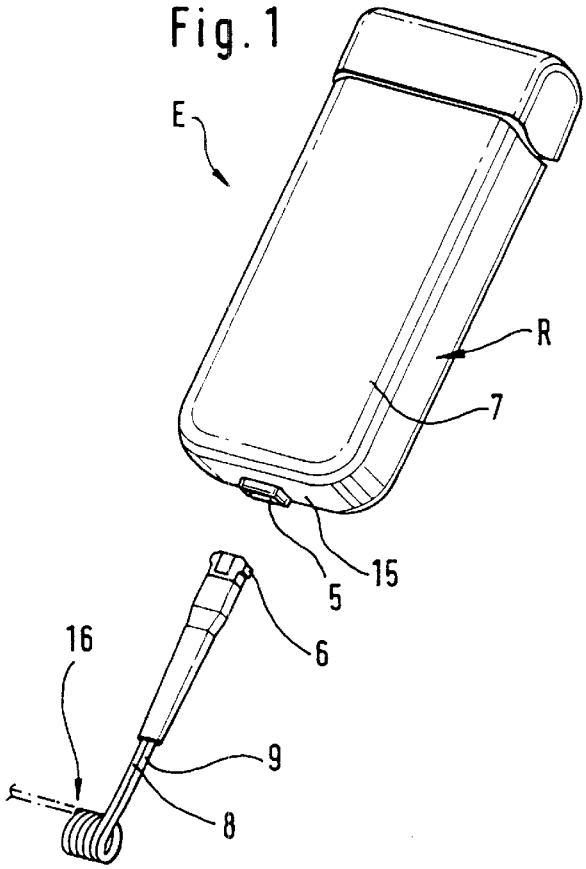

FIG. 1 shows a perspective view of an electric appliance E in the form of a shaving apparatus R. Provided in the housing base 15 of the housing 7 of the shaving apparatus R is a socket 5 for connecting a plug 6 of a power cord 16.

Figure 2:
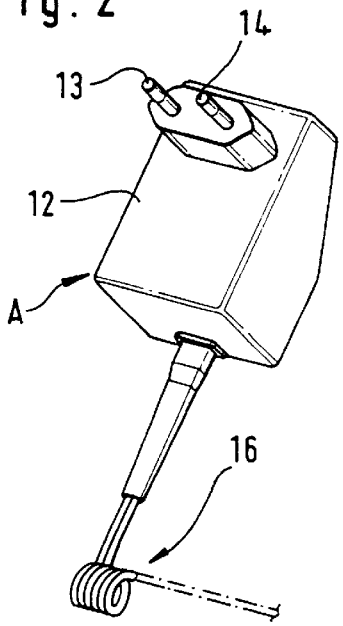
FIG. 2 is a perspective view of a line adapter having a power cord with a plug adapted to be coupled to the socket of the shaving apparatus R.

FIG. 2 shows a perspective view of a line adapter A with a power cord 16 having a plug 6 adapted to be coupled to the socket 5 of the shaving apparatus R. Two plug pins 13 and 14 for connecting to a voltage supply are provided on the line adapter A. The power cord 16 can be fastened in the adapter housing 12 of the line adapter A or be pluggable into it. The power cord 16 is used for the polarized transfer of voltage. For this purpose the presented embodiment is provided with a current lead 8 for transferring a voltage to at least one contact element of a first pole (+) and with a current lead 9 for transferring a voltage to at least one contact element of a second pole (−).

Figure 3:
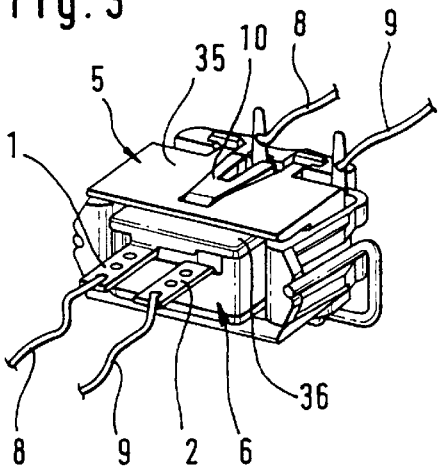
FIG. 3 is a perspective view of a socket and a plug in coupled condition.

FIG. 3 shows a perspective view of a socket 5 and a plug 6 in the coupled state. The current lead 8—see FIG. 1—of the power cord 16 leads to a contact element 1 of a first pole (+) of the plug 6, while the current lead 9 goes to a contact element 2 of a second pole (+) of the plug 6. The contact element 10 of the socket 5 making contact with the contact element 1 is electrically conductively connected with a further extending current lead 8, and the contact element 20 of the socket 5 making contact with the contact element 2 is likewise electrically conductively connected with a further extending current lead 9. These further extending leads 8 and 9 lead to an electric drive or to a charging circuitry of an electric appliance E, for example, a shaving apparatus R of FIG. 1. The essentially rectangular-shaped socket housing 35 of the socket 5 is partly embraced by a holding device 37 and a spring element 38—see FIG. 5—for holding securely captured a plug 6 located in the interior of the socket housing 35.

Figure 4:
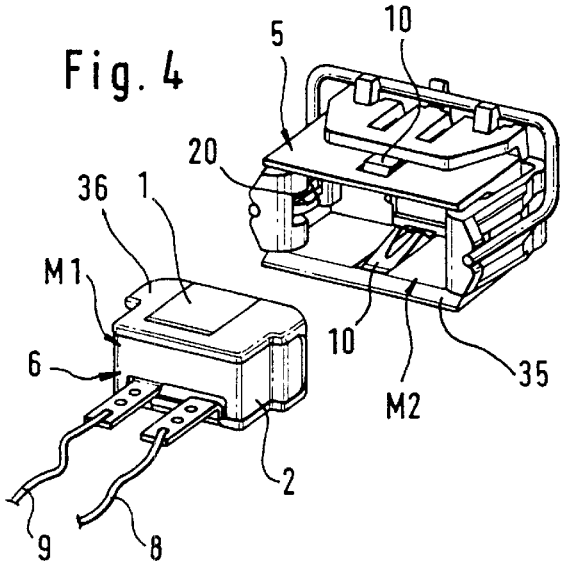
FIG. 4 is an exploded view of a socket and a plug as well as of a holding device.

FIG. 4 shows an exploded view of a socket 5 and a plug 6. The plug 6, which is constructed as a polygonal profile body M1, has an essentially U-shaped contact element 1 and an essentially U-shaped contact element 2—see FIG. 6—so that relatively large contact faces for voltage transfer are formed on each side of the plug body 36 of the plug 6. The socket housing 35 of the socket 5 is shown turned through 180° compared to the presentation of FIG. 3. The socket housing 35 has an interior space whose wall faces 55, 56, 57 and 58 form a hollow polygonal profile body M2. The inner dimensions of the hollow polygonal profile body M2 are selected such as to ensure engagement of the contact elements 1 and 2 of the insertable plug 6, which is constructed as a polygonal profile body M1, with the contact elements 10 and 20 in the socket housing 35 of the socket 5.

Figure 5:
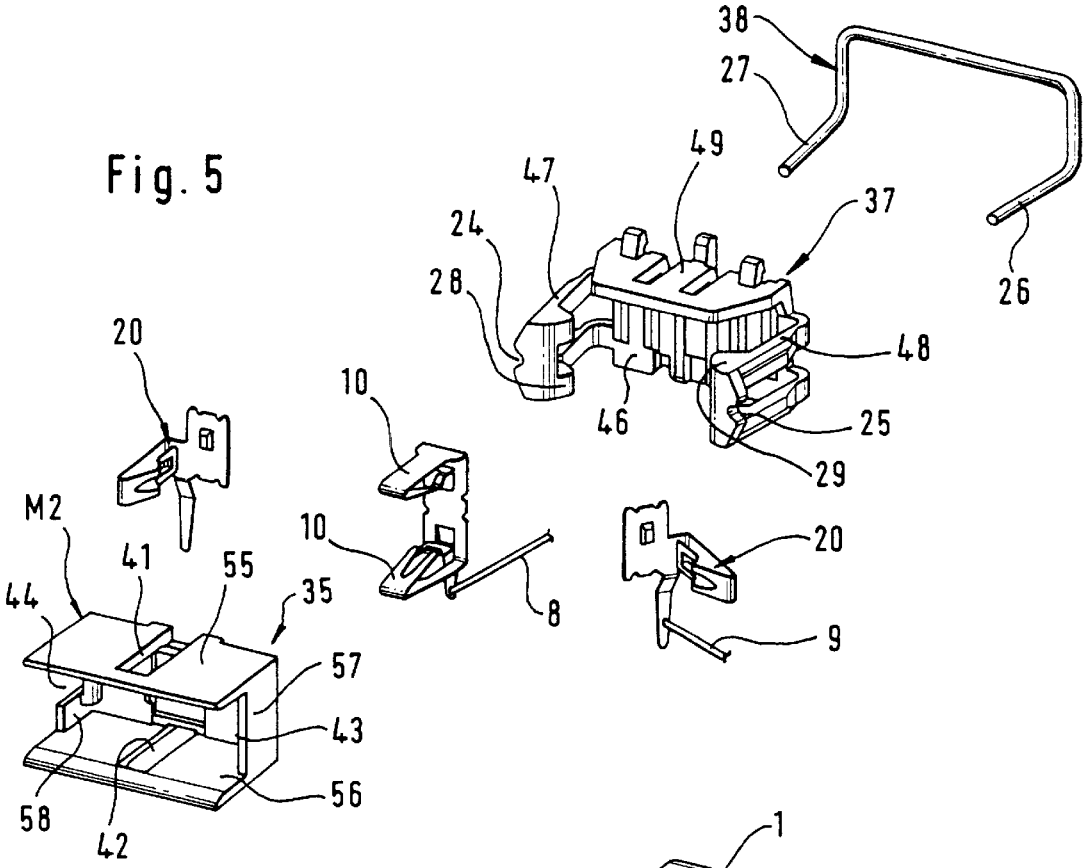
FIG. 5 is an exploded view of all the components of a socket and of a holding device.

FIG. 5 shows an exploded view of the various components of the socket 5 and of the holding device 37 which partly embraces the socket housing 35. Provision is made in the mutually opposing wall faces 55, 56 and 57 and 58 of the socket housing for openings 41 to 44 to receive the contact elements 10 and 20. In the embodiment of FIG. 5 the contact element 10 is of a U-shaped configuration, for example, comprising multi-feathered contact springs projecting into the U-shape and extending, in the assembled state, through the openings 41 and 42 of the wall faces 55 and 56 of the socket housing. A contact finger for connecting the current lead 8 is provided on the contact element 10. The openings 42 and 43 in the side walls 57 and 58 of the socket housing 35 serve to receive the essentially L-shaped contact elements 20, which likewise have inwardly bent multi-feathered contact springs and a contact finger for connecting a current lead 9. With the plug 6 and socket 5 in coupled condition, the springy contact elements 20 engage the end faces of the U-shaped contact element 2 of the plug 6. It is also possible for the two L-shaped contact elements 20 to be combined to form a U-shaped contact element. By means of one U-shaped contact element it is possible to obtain two contactable contact faces that can be provided either as contact faces of a first pole (+) or a second pole (−) on a plug 6 and/or a socket 5.

The holding device 37 essentially comprises a rear wall 46 and two end walls 47 and 48 arranged for movement relative thereto, and a support wall 49 provided on the rear wall 46 at right angles thereto. The mobility of the end wall 48 and/or the end wall 47 can be ensured either by means of a mechanical joint or by forming the end wall 47, 48 on the rear wall by means of a film hinge. When the socket housing 35, complete with contact elements 10 and 20, is assembled with the holding device 37, the end walls 47 and 48 are urged by the spring legs 26 and 27 of a U-shaped spring element 38 in the direction of the interior space of the socket housing 35. For improved guidance and holding of the spring element 38 at the holding device 37 provision is made in the end walls 47 and 48 for recesses 24 and 25 to receive the spring legs 26 and 27.

FIG. 6 shows a perspective view of a plug body 36, constructed as a polygonal profile M1, of a plug 6, in whose side walls provision is made for recesses for receiving an essentially U-shaped contact element 1 and an essentially U-shaped contact element 2. The relatively narrow ends of the plug body 36 extending in opposed relation to each other and the respective legs of the U-shaped contact element 2 engaging them are recessed in steps in order for the stepped shoulders of the plug 6 to provide a detent action in cooperation with holding lugs 28 and 29 provided on the end walls 47 and 48 of the holding device 37, which on the one hand holds the plug 6 securely captured within the socket 5 and on the other hand is easy for the user to overcome both when inserting and removing the plug 6 in and from the socket 5.

FIG. 6*a* shows a resilient contact element 20 in engagement with a rigid contact element 2. By virtue of the resilient characteristics and the attendant compliance of the contact element 20 a relatively large area of engagement results between the contact element 20 and the contact element 2. Given a feathered construction of the contact element 20—see FIG. 5—several large-surface contacts according to the number of feathers are made between the contact element 20 and the contact element 2.

FIGS. 7 to 17 show various embodiments of intermateable plugs 6 and sockets 5. The respective plug body 36 of the plug 6 is constructed as a polygonal profile body M1, M3, M5, M7, M9, M11, on whose wall faces 51, 52, 53, 54 and 59 provision is made for contact elements 1 to 4 of varying quantity with both a first pole (+) and a second pole (−), such that the contact elements of the first pole (+) and of the second pole (−) are arranged in alternating sequence in one of the directions of rotation U about the symmetry axis S on the corresponding polygonal profile body faces. Associated with the respective polygonal profile body M1, M3, M5, M7, M9, M11 of the plug 6 is a socket 5, whose inner space formed by wall faces 51 to 60 has the form of a polygonal profile body M2, M4, M6, M8, M10, M12 such as to ensure both the plugging together by positive engagement and the reversing of plug 6 and socket 5 in each of the embodiments illustrated in FIGS. 7 to 17.

On the illustrated polygonal profile bodies M1 to M12 provision is made for contact elements 1 to 4, 10, 20, 30, 40 of a first pole (+) and a second pole (−), such that the contact elements of the first pole (+) and the second pole (−) are arranged in alternating sequence in a direction of rotation U about the symmetry axis S, meaning for example that pole (+), pole (−), pole (+), pole (−) are arranged on the polygonal profile body faces of the polygonal profile bodies M1 to M12. In the illustrated embodiments of FIGS. 7 to 17 the contact element 1 and the contact element 3 have a positive polarity (+), and the contact element 2 and the contact element 4 have a negative polarity (−). This arrangement of contact elements on the polygonal profile body faces of the polygonal profile bodies M1 to M12 of the socket 5 and the plug 6 guarantees, in conjunction with the intermating of the polygonal profile bodies of plug 6 and socket 5 by positive engagement, a properly poled contact both when plugging the plug in the socket and when reversing it from one plug-in position into at least one further plug-in position.

In the embodiments of FIGS. 7 to 15 the polarity of the first pole (+) is assigned to the contact elements 1, 3, 10 and 30, and the polarity of the second pole (−) is assigned to the contact elements 2, 4, 20, 40. In addition, the contact elements with the polarity of the first pole (+) and the contact elements with the polarity of the second pole (−) are arranged in centrosymmetric relation to each other on the wall faces of the polygonal profile bodies M1, M3, M5, M7 of the plug 6 and on the polygonal profile body faces of the polygonal profile bodies M2, M4, M6, M8. The only exception to this rule is the polygonal profile body M2 of the embodiment of FIG. 8, which has one contact element 20 on only one narrow side of the polygonal profile body.

Figure 7:
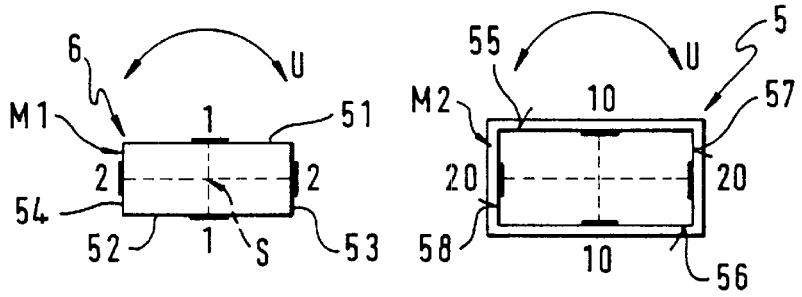

FIG. 7 shows a plug 6 and a socket 5 whose reversible polygonal profile bodies M1 and M2 are constructed as rectangular profiles. On the broad sides of the polygonal profile body M1 provision is made for a respective contact element 1 of the first pole (+), and on the opposite narrow sides of the polygonal profile body M2 provision is made for a respective contact element 2 of the second pole (−). The polygonal profile body M2 of the socket 5, which is matched to form-fit the polygonal profile body M1 and is defined by wall faces 55 to 58, has on each of its longitudinal sides a respective contact element 10 of the first pole (+) and on the two narrow sides extending in opposed relation to each other a respective contact element of the second pole (−) so that a properly poled contact between the contact elements 1, 10 of the first pole (+) and the contact elements 2, 20 of the second pole (−) is ensured both when these two polygonal profile bodies M1 and M2 are plugged together and when the polygonal profile body M1 is reversed within the polygonal profile body M2 of the socket 5.

Figure 8:
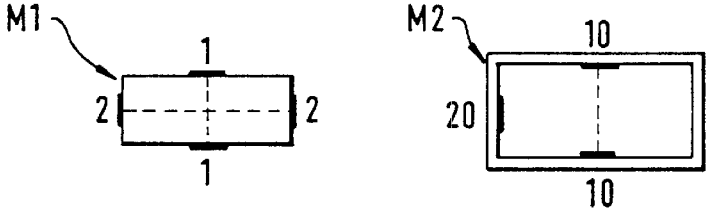

The embodiment of FIG. 8 shows a polygonal profile body M1 whose profile and contact with the contact elements 1, 2 comply with the embodiment of the polygonal profile body M1 of FIG. 7. The polygonal profile body M2 of the socket 5 largely corresponds to the embodiment M2 of FIG. 7. Unlike this embodiment, however, no provision is made on one of the narrow sides of the polygonal profile body M2 for a contact element 20. A properly poled contact with the contact elements of the polygonal profile body of the plug 6 is guaranteed nevertheless.

Figure 9:
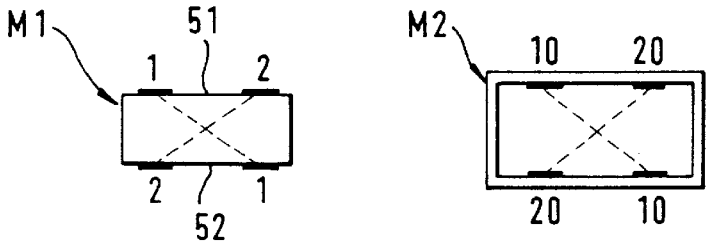

FIG. 9 shows an embodiment of the polygonal profile body M1 described in connection with FIG. 7 and of the polygonal profile body M2 of the plug 6 on which, unlike in FIG. 7, the contact elements of the first pole (+) and the contact elements of the second pole (−) are each arranged in centrosymmetric relation to each other on the two wall faces 51, 52. The same arrangement is also provided in the polygonal profile body M2 of the socket 5 so that when the polygonal profile body M1 is coupled with the polygonal profile body M2 there is guaranteed to be correct contact between contact elements with the polarity of the first pole (+) and between contact elements with the polarity of the second pole (−).

Figure 10:
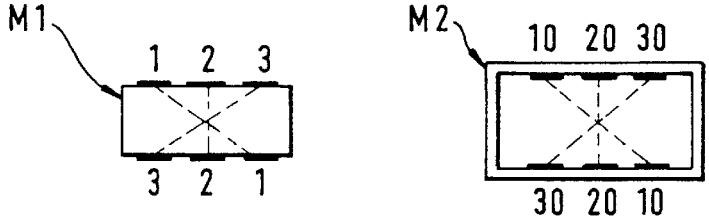

FIG. 10 shows a further embodiment of the contact between the polygonal profile bodies M1 and M2 such that provision is made on each longitudinal side for a further contact element 3 with the polarity of the first pole (+), and on the polygonal profile body M2 accordingly for a further contact element 30 with the polarity of the first pole (+).

Figure 11:
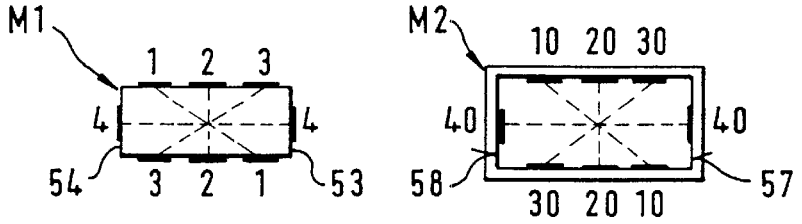

The arrangement of the contact elements of FIG. 11 differs from the embodiment of FIG. 10 in that provision is made on the wall faces 53, 54 of the narrow sides of the polygonal profile body M1 for a further contact element 4 with the polarity of the second pole (−), and on the wall faces 57, 58 of the narrow sides of the polygonal profile body M2 for a contact element 40 with the polarity of the second pole (−). A properly poled contact when the plug 6 and the socket 5 are in coupled condition is ensured in that the contact elements with the polarity of the first pole (+) and with the polarity of the second pole (−) are provided in alternating sequence in a direction of rotation U on the polygonal profile body faces of the polygonal profile bodies M1, i.e., 1, 2, 3,/4/1, 2, 3/4—and M2—i.e., 10, 20, 30/40/10, 20, 30/40.

Figure 12:
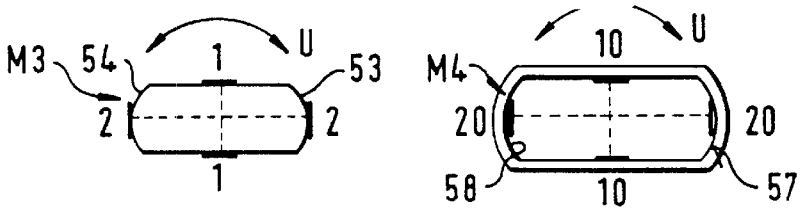
Figure 13:
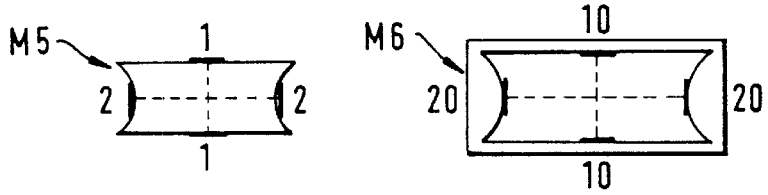

The embodiment of FIG. 12 shows polygonal profile bodies M3 and M4 of essentially rectangular construction, the narrow wall faces 53, 54 of the polygonal profile body M3 being concave while the narrow wall faces 57, 58 of the polygonal profile body M4 are convex. Contact between the polygonal profile bodies M3 and M4 complies with the contact between the polygonal profile bodies M1 and M2 of FIG. 7. The embodiment of the polygonal profile bodies M5 and M6 of FIG. 13 differs from the embodiment of the polygonal profile bodies M3 and M4 of FIG. 12 only in that the narrow wall faces 53, 54 of the essentially rectangular polygonal profile body M5 are convex, while the narrow wall faces 57, 58 of the polygonal profile body M6 are concave.

Figure 14:
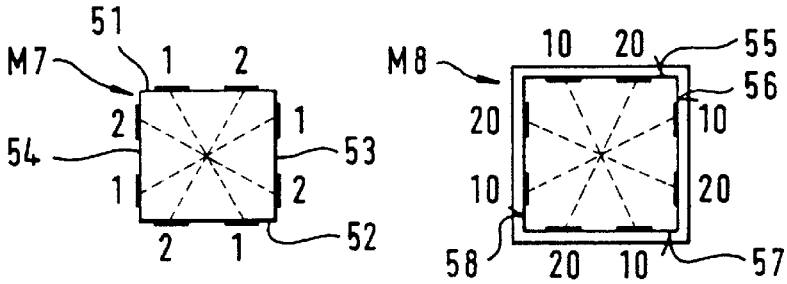
Figure 15:
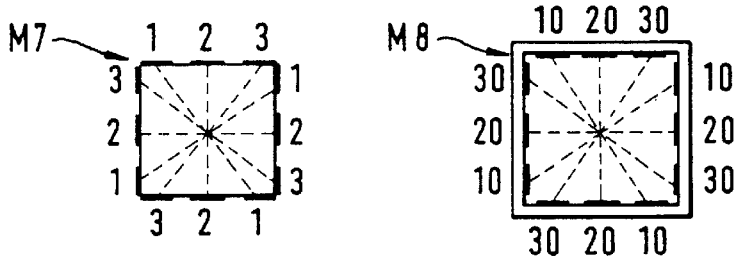

In the embodiments of FIGS. 14 and 15 the polygonal profile bodies M7 of the plug 6 and the polygonal profile bodies M8 of the socket 5 are constructed from reversible square profile bodies. In the embodiment of FIG. 14 provision is made on each wall face 51 to 54 and 55 to 58 for a respective contact element 1, 10 with the polarity of the first pole (+) and a respective contact element 2, 20 with the polarity of the second pole (−), such that they are arranged in centrosymmetric relation to each other. In the embodiment of FIG. 15 provision is made on each wall face 51 to 58 for a further contact element 3, 30 with the polarity of a first pole (+) in centrosymmetric relation to a further contact element 3, 30 with the polarity of the first pole (+), so that a properly poled contact between the provided contact elements is ensured when reversing the plug 6 in the socket both through 90° and through 180°.

Figure 16:
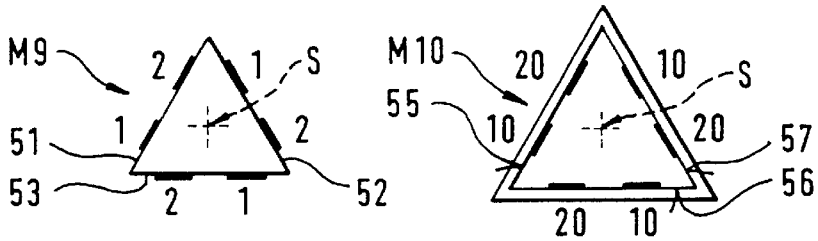

In the embodiment of FIG. 16 the polygonal profile bodies of the plug 6 and of the socket 5 are formed from a triangular profile body, which can be reversed about the symmetry axis S and has equal side walls. Correctly poled plugging in and reversing of the plug 6 in the socket 5 is guaranteed in that provision is made on each of the wall faces 51, 52, 53 for one contact element of a first pole (+) and one contact element of a second pole (−), such that these contact elements are arranged in alternating sequence in a direction of rotation U on the polygonal profile body faces of the polygonal profile bodies M9 and M10.

Figure 17:
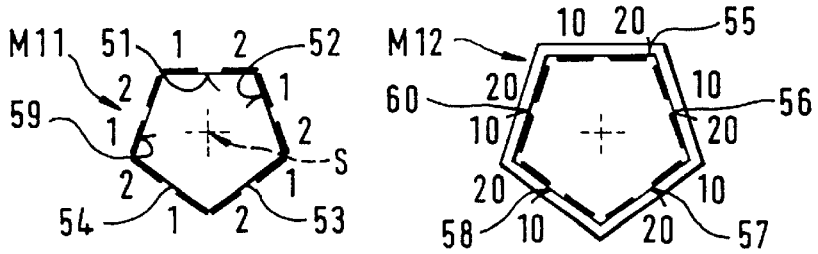

According to FIG. 17 the polygonal profile body M11 of the plug 6 and the polygonal profile body M12 of the socket 5 are constructed as reversible pentagonal profile bodies. Contact between the wall faces 51, 52, 53, 54, 59 and 55, 56, 57, 58, 60 is made by providing on each wall face one contact element of a first pole (+) and one contact element of a second pole (−), with the contact elements being arranged in alternating sequence in terms of similar and dissimilar polarity in the direction of rotation U.

What is claimed is:

1. A multipole connector assembly for connection of a low voltage to an electric appliance of personal use, comprising:

a socket with contactable contact elements for polarized voltage transfer; and a plug that is insertable into said socket, said plug also having contactable contact elements for a polarized voltage transfer, wherein the socket and the plug are constructed as polygonal profile bodies that provide multiple plug-in positions, all of which multiple plug-in positions being related to each other by rotation about a symmetry axis, wherein the contact elements on each of the plug and of the socket include at least one first pole (+) and one second pole (−), wherein the contact elements of the first pole (+) and the second pole (−) are provided on polygonal profile body faces of the polygonal profile bodies in alternating sequence in a common direction of rotation, and wherein on at least one of the polygonal profile bodies the contact elements have a relatively large contact face for making large-surface contact with a contact face of an engaging contact element on the other polygonal profile body.

2. A multipole connector assembly for connection of a low voltage to an electric appliance of personal use, comprising:

a socket with contactable contact elements for polarized voltage transfer; and a plug that is insertable into said socket, said plug also having contactable contact elements for a polarized voltage transfer, wherein the socket and the plug are constructed as polygonal profile bodies that provide multiple plug-in positions, all of which multiple plug-in positions being related to each other by rotation about a symmetry axis, wherein the contact elements on each of the plug and of the socket include a first pole (+) and a second pole (−), wherein contact elements of the first pole (+) and the second pole (−) are provided on one of the plug and the socket in alternating sequence and in number equal to 2 n, where n is an integer, and wherein on the other one of the plug and the socket the contact elements of the first pole (+) are provided in number equal to m and the contact elements of the second pole (−) are provided in number equal to s that differs from m by 1, wherein the m+s=2 n−1.

3. A multipole connector assembly for connection of a low voltage to an electric appliance of personal use, comprising:

a socket with contactable contact elements for polarized voltage transfer; and a plug that is insertable into said socket, said plug also having contactable contact elements for a polarized voltage transfer, wherein the socket and the plug are constructed as polygonal profile bodies that provide multiple plug-in positions, all of which multiple plug-in positions being related to each other by rotation about a symmetry axis, wherein the contact elements on each of the plug and of the socket include at least one first pole (+) and one second pole (−), wherein the contact elements of the first pole (+) and of the second pole (−) are provided on polygonal profile body faces of the polygonal profile bodies in alternating sequence in a common direction of rotation, and wherein the total number of contact elements on at least one of the plug and the socket is greater than three.

4. The connector assembly according to claim 3, wherein at least one of the plug contact elements is provided on each of the polygonal profile body faces of the plug.

5. The connector assembly according to claim 3, wherein at least one of the socket contact elements is provided on each of the polygonal profile body faces of the socket.

6. The connector assembly according to claim 3, wherein at least two of the plug contact elements of the first pole (+) are provided in opposed relation to each other on the polygonal profile body of the plug.

7. The connector assembly according to claim 3, wherein at least two of the plug contact elements of the second pole (−) are provided in opposed relation to each other on the polygonal profile body of the plug.

8. The connector assembly according to claim 3, wherein at least two of the socket contact elements of the first pole (+) are provided in opposed relation to each other on the polygonal profile body of the socket.

9. The connector assembly according to claim 3, wherein at least two of the socket contact elements of the second pole (−) are provided in opposed relation to each other on the polygonal profile body of the socket.

10. The connector assembly according to claim 3, wherein the contact elements of the first pole (+) and the second pole (−) are provided on opposite and/or neighboring walls of the plug and the socket.

11. The connector assembly according to claim 3, wherein the plug contact elements are provided on at least two polygonal profile body faces of the polygonal profile body of the plug.

12. The connector assembly according to claim 3, wherein the socket contact elements are provided on at least two polygonal profile body faces of the polygonal profile body of the socket.

13. The connector assembly according to claim 3, wherein two contact elements of the first pole (+) and one contact element of the second pole (−) are provided on the polygonal profile body of one of the socket and the plug, and two contact elements of the first pole (+) and two contact elements of the second pole (−) are provided on the polygonal profile body of the other one of the plug and the socket.

14. The connector assembly according to claim 3, wherein all polygonal profile body faces of the plug have the same arrangement of contact elements and each such face has at least one plug contact element of a first pole (+) and at least one plug contact element of a second pole (−) and the contact elements on the socket are arranged in the same order of polarity of the contact elements provided on the plug.

15. The connector assembly according to claim 3, wherein the polygonal profile bodies of the plug and of the socket are formed from reversible four-cornered profile bodies with at least two contact elements of dissimilar polarity, with the contact elements of the first pole (+) and of the second pole (−) being provided in centrosymmetric relation to each other on the polygonal profile body faces of the plug and of the socket.

16. The connector assembly according to claim 3, wherein the polygonal profile bodies of the plug and of the socket are formed from reversible rectangular profiles.

17. The connector assembly according to claim 3, wherein the polygonal profile bodies of the plug and of the socket are formed from reversible square profile bodies.

18. The multipole connector assembly according to claim 3, wherein the polygonal profile bodies of the plug and of the socket are formed from reversible triangular profile bodies.

19. The multipole connector assembly according to claim 3, wherein the polygonal profile bodies of the plug and of the socket are formed from reversible pentagonal or hexagonal profile bodies.

20. The connector assembly according to claim 3, wherein the polygonal profile body of the plug has at least two outer walls extending parallel to each other and further walls of congruent form linking the aforesaid outer walls to form a closed geometrical body.

21. The connector assembly according to claim 3, wherein the polygonal profile body of the socket has at least two inner walls extending parallel to each other and further walls of congruent form linking the aforesaid inner walls to form a closed geometrical body.

22. The connector assembly according to claim 3, wherein the contact elements of one of the plug and the socket are constructed as contact plates.

23. The connector assembly according to claim 3, wherein at least two contact elements of one of the plug and the socket is formed by an essentially U-shaped conducting element.

24. The connector assembly according to claim 3, wherein at least one contact element of one of the plug and the socket is formed by an essentially L-shaped conducting element.

25. The connector assembly according to claim 3, wherein at least two U-shaped conducting elements are provided on a polygonal profile body of the plug and/or socket, one of said at least two conducting elements implementing at least two contacting elements of a first pole being and another of said at least two conducting elements implementing at least two contacting elements of a second pole.

26. The connector assembly according to claim 3, wherein at least one U-shaped conducting element and at least two L-shaped conducting elements are provided on the polygonal profile body of the plug and/or socket, said at least one U-shaped conducting element implementing at least two contacting elements and each of said at least two L-shaped conducting elements implementing at least one contacting element.

27. The connector assembly according to claim 3, wherein the polygonal profile body of the plug is part of a power cord.

28. The connector assembly according to claim 3, wherein the polygonal profile body of the plug is part of an electric appliance.

29. The connector assembly according to claim 3, wherein the polygonal profile body of the socket is part of a power cord.

30. The connector assembly according to claim 3, wherein the polygonal profile body of the socket is part of an electric appliance.

31. The connector assembly according to claim 3, wherein the polygonal profile bodies of the plug and the socket are part of two power cords adapted to be coupled together.

32. The connector assembly according to claim 3, wherein at least one of the polygonal profile body faces of the polygonal profile body of the plug and/or socket is spring-loaded.

33. The connector assembly according to claim 32, wherein the spring-loaded face is equipped with a detent hook.

34. The connector assembly according to claim 32, wherein each of at least two opposing walls of the polygonal profile body of the socket or the plug are attached to the rest of the polygonal profile body by a film hinge.

35. The connector assembly according to claim 32, wherein the spring-loaded wall is adapted to be acted upon by a spring element.

* * * * *